US005962128A

United States Patent [19]

Kuroyama

[11] Patent Number: 5,962,128

[45] **Date of Patent: *Oct. 5, 1999**

[54] INK JET RECORDING PAPER

[75] Inventor: Yoshihiro Kuroyama, Tokyo, Japan

[73] Assignee: Nippon Paper Industries Co., Ltd., Japan

[ * ] Notice: This patent is subject to a terminal disclaimer.

[21] Appl. No.: 08/613,180

[22] Filed: Mar. 8, 1996

[30] Foreign Application Priority Data

Mar. 10, 1995 [JP] Japan ..... 7-079627

[51] Int. Cl.[6] ..... B41M 5/00

[52] U.S. Cl. ..... 428/342; 428/195; 428/206; 428/211; 428/331; 428/340; 428/341; 428/537.5

[58] Field of Search ..... 428/195, 206, 428/211, 331, 537.5, 340–342

[56] References Cited

U.S. PATENT DOCUMENTS 5,126,010 6/1992 Kobayashi et al. ..... 428/481

5,213,873 5/1993 Yasuda et al. ..... 428/195

5,320,897 6/1994 Kondo et al. ..... 428/195

5,342,876 8/1994 Abe et al. ..... 428/331

5,522,968 6/1996 Kuroyama et al. ..... 428/537.5

*Primary Examiner*—Pamela R. Schwartz

*Attorney, Agent, or Firm*—Millen, White, Zelano & Branigan, P.C.

[57] ABSTRACT

An ink jet recording paper for recording with an ink based on a water-soluble dye having mainly carboxyl groups as hydrophilic functional groups, said recording paper not containing calcium carbonate, and being formed from a base paper comprising kaolin and/or illite as filler and a recording layer provided on at least one side of said base paper comprising a water-absorbing pigment and an aqueous binder as its principal components, the amount of solids in said layer lying in the range 0.5–3.0 g/m$^2$ on each side of said paper on which said layer is provided.

3 Claims, No Drawings

INK JET RECORDING PAPER

FIELD OF THE INVENTION

This invention relates to an ink jet recording paper, and more specifically to an ink jet recording paper having good color rendering properties when used not only with conventional types of ink, but also with water-soluble inks having carboxyl groups as functional groups having excellent waterproof properties after recording.

BACKGROUND OF THE INVENTION

In ink jet recording, small ink droplets are ejected by one of a variety of different mechanisms so that they adhere to a recording paper on which they form dots. Apart from the fact that this method is less noisy than dot impact recording, it is easy to achieve full color images and high speed printing is possible. However, the inks used in ink jet recording are normally water-based inks that employ direct dyes or acidic dyes, and therefore have poor drying properties.

The properties required of an ink jet recording paper used in this ink jet recording method are:

(1) high ink drying speed, (2) high optical density of image, (3) the ink does not overflow or blur, (4) the paper does not crease due to absorbing ink, (5) the print is highly waterproof.

Now that the color technology of ink jet printers is improving and their prices are decreasing, the use of color ink jet printers by individual consumers is rapidly becoming more widespread.

These color printers reproduce a variety of colors by combining inks of the single colors cyan, magenta, yellow and black inks, consequently the amount of ink adhering in the mixed ink areas is from 2 to 3 times as much as the amount of ink adhering in the case of monochrome printers. Hence, when ordinary non-coated papers, such as the kind of paper used in conventional monochrome printers, are used in a color printer, the amount of ink absorbed is inadequate resulting in strike through or overflow. Conventional heavily coated type papers, on the other hand, were difficult to handle and did not have the texture of ordinary paper. There was therefore a demand for a lightly coated paper. To improve the waterproof properties of print produced by ink jet printers, the water-soluble dyes used in inks are made more difficultly soluble by replacing sulfo groups in the dye with carboxyl groups (R. W. Kenyon, 9th International Congress on Advances in Non-Impact Printing Technologies/Japan Hardcopy '93, p. 279 (1993)).

As carboxyl groups are usually weakly acidic, under alkaline conditions dissociation is promoted so that the dye dissolves, but under relatively strongly acidic conditions, it is present as a free carboxylic acid so that dissolution is prevented. The improved waterproof properties of the dye are due to this principle. The dye is dissolved in ink of comparatively high pH, but after printing when the dye adheres to paper, as the pH of the paper surface is relatively low, the dye is present as the free acid and is therefore rendered difficultly soluble. Such dyes which have been rendered difficultly soluble are described together with their chemical structure in the aforementioned reference in the literature, and they all possess carboxyl groups.

Of these dyes, some possess both carboxyl groups and sulfo groups, but it is the solubility of the carboxyl groups which varies due to the change of pH before and after printing. Since dyes which possess carboxyl groups react strongly with alkaline earth metal ions, changes of color rendering properties easily occur, and salts which are difficultly soluble in water are easily formed.

In the event of such a change of color rendering properties, the print quality of printed documents obviously deteriorates, and if a difficultly soluble salt is produced, a metallic gloss appears which also impairs print quality.

In recent years, the use of neutral paper has become more widespread replacing the acidic paper which was mainly used conventionally. This neutral paper comprises calcium carbonate as a filler, and is known as calcium carbonate paper. When the aforesaid water-resistant inks were used on this neutral paper, it was therefore a frequent occurrence that the calcium carbonate in the paper reacted with the aforesaid dye comprising carboxyl groups, causing a change of color rendering properties and a deterioration of print quality.

When the inventors attempted to improve these defects by providing a recording layer on neutral paper, they found that even in the case of a coated paper using calcium carbonate paper as a base paper, a lightweight coating of approximately 7 g/m$^2$ or less did not suffice to completely cover the base paper so that the same deterioration of print quality occurred as mentioned hereinabove.

They found moreover that when a relatively strongly alkaline salt such as calcium carbonate was used as a filler, the carboxyl groups in the dye tended to dissociate even if the calcium carbonate did not react with the pigment so that the improvement of waterproof properties was not as great as had initially been expected. There was also a disadvantage in that the dye penetrated the paper so that optical density decreased.

The inventors discovered as a result of intensive studies that when recording was performed using water-soluble inks comprising mainly carboxyl groups as hydrophilic functional groups, an ink jet recording paper which provided high print quality and printed materials having excellent waterproof properties could be obtained even with a lightweight coating by avoiding the use of calcium carbonate as filler and using a base paper comprising kaolin and/or illite.

SUMMARY OF THE INVENTION

It is therefore an object of this invention to provide an ink jet recording paper which provides excellent print quality without any change of color rendering properties or appearance of metallic gloss.

The aforesaid aims and objects of the invention are attained by an ink jet recording paper using a water-soluble dye comprising mainly carboxyl groups as hydrophilic functional groups, this recording paper comprising (1) a base paper not containing calcium carbonate but comprising a kaolin and/or illite as a filler, and (2) a recording layer provided on at least one side of this base paper comprising a water-absorbing pigment and aqueous binder as its principal components, the amount of solids in this layer lying in the range 0.5–3.0 g/m$^2$ on each side of the paper on which the layer is provided.

DETAILED DESCRIPTION OF THE INVENTION

The ink using a water-soluble dye comprising mainly carboxyl groups as functional groups according to this invention, is an ink (referred to hereinafter simply as ink) comprising a water-soluble dye comprising at least carboxyl groups of which the dissociation is promoted under alkaline conditions causing dissolution, but which exists as a free carboxylic acid under relatively strongly acidic conditions causing the dye to become difficultly soluble.

Such a dye dissolves in ink of relatively high pH, but after printing when the adheres to a paper surface, as the pH of the paper surface is relatively low, the dye is converted to the free acid form and is thereby rendered difficultly soluble. Specific examples of such dyes are described in R. W. Kenyon, 9th International Congress on Advances in Non-Impact Printing Technologies/Japan Hardcopy '93, p. 279 (1993).

The filler used in the base paper of the ink jet recording paper according to this invention does not contain any calcium carbonate and comprises kaolin and/or illite in order to prevent reaction with the dye in the ink which would cause a change of color rendering properties, appearance of a metallic gloss due to production of a salt difficultly soluble in water and deterioration of print quality.

Kaolin is a naturally occurring substance represented by the formula $Al_4[Si_4O_{10}](OH)_8$, and the pH of a dispersed slurry of kaolin is in the vicinity of 5. Illite is a naturally occurring substance represented by the formula $K_{1.5}AL_4[Si_{6.5}AL_{1.5}]O_{20}(OH)_4$, and the pH of a dispersed slurry of illite is in the vicinity of 7. Consequently, neither kaolin nor illite has any effect on printing. The amount of kaolin and/or illite used is normally in the range of 3–30 wt % of the base paper.

There is no particular limitation on the pigment used for the recording layer of the recording paper according to this invention provided that it is a water-absorbing pigment. The use of amorphous silica which has a relatively large specific surface area is to be preferred. The amorphous silica referred to herein is the white carbon and amorphous silica referred to on p.267 of the Applied Chemistry Section of the Chemical Handbook (Kagaku Binran Oyou Kagaku Hen) by the Chemical Society of Japan, published on Oct. 15, 1986 by Maruzen K.K.

There is no particular limitation on the binder used in the recording layer of the recording paper according to this invention provided that it is an aqueous binder. Examples of such binders are starches such as oxidized starch and esterified starch, cellulose derivatives such as carboxymethylcellulose and hydroxyethylcellulose, polyvinyl alcohol and its derivatives, polyvinylpyrrolidone, casein, gelatin, soybean protein, styrene/acrylic resins and their derivatives, styrene/butadiene latex, acrylic emulsions, and vinyl acetate emulsion. The proportion of the binder preferably lies within a range of 10–100 weight parts to 100 weight parts of pigment.

The coating color used for the recording layer is prepared by blending the aforesaid pigment and binder with water, and various salts may be added as may be appropriate so as to adjust the pH to 5.5–7.5. The pH may be adjusted also by adjusting the pH of the pulp slurry used for the base paper.

When the pH is less than 5.5, the color rendering properties of phthalocyanin type cyan inks are particularly adversely affected. On the other hand, increasing the pH above 7.5 leads to a deterioration of waterproof properties or the optical density of printed materials. pH may be measured by the method described hereinafter.

Sizing agents, water repellents, pigment dispersants, water retention agents, thickeners, defoaming agents, preservatives, coloring agents, waterproofing agents, wetting agents, fluorescent dyes, ultraviolet absorption agents and cationic polymer electrolytes may be added to the coating color as necessary and appropriate.

The coating may be chosen from any known methods using a coating tool such as a blade coater, air knife coater, roll coater, brush coater, kiss coater, squeeze coater, curtain coater, bar coater, gravure coater or comma coater. These may be used either as off-machine or on-machine coaters. In the case of on-machine coating, coating tools known in the art such as size press coaters and gate roll coaters may also be used.

The coating of the recording layer is such that the recording paper retains the textural properties of ordinary paper, the amount of solids in the coating preferably lying within the range of 0.5–3.0 g/m$^2$, and more preferably within the range of 0.7–2.5 g/m$^2$.

Although the ink jet recording paper according to this invention has a lightweight coating, there is no change of color rendering properties nor appearance of a metallic gloss, and excellent print quality is obtained even when recording is performed on the paper using a water-soluble dye comprising mainly carboxyl groups as hydrophilic functional groups. In addition, the printed materials so obtained have excellent waterproof properties.

EXAMPLES

This invention will now be described in further detail with reference to specific examples, however it shall be understood that these examples are not be construed as limiting the invention in any way. The tests, measurement methods and reference standards used in the examples and comparative examples are as described hereinbelow.

1 Paper Surface pH

Distilled water was run over the paper surface, and a surface pH measurement sensor (GST-5313F) of a pH meter (HM-30S) (TOA Electronics Ltd.) was brought into contact with the surface.

2 Evaluation of Color Rendering Properties

Printing was performed using a bubble jet color printer (BJC-400J: Canon Inc.), with black and cyan ink. Color rendering properties were visually assessed according to the following criteria.

1. No change of color rendering properties ○
2. Change of color rendering properties found x 3 Image Quality To assess image quality, the extent of ink blurring (feathering) was evaluated.

4 Waterproof Properties

To assess waterproof properties, the image remaining after the printed material was immersed in water for 5 minutes, was evaluated.

1. Practically no running of the image ○
2. Slight running of the image Δ
3. Heavy running of the image x 5 Textural Properties (Ordinary Paper Texture To assess textural properties, the resemblance to ordinary paper was assessed.

Example 1

85 weight parts of LBKP (c.s.f. 350 ml), 15 weight parts of kaolin as paper filler and 0.2 weight parts of a hydrophobic modified rosin emulsion sizing agent were blended together, and an ink jet recording paper of weighting 81.4 g/m$^2$ was manufactured using a Fourdrinier paper machine. The following coating color was then applied to the surface of the base paper using a gate roller.

Coating Color 100 weight parts of Aerosil No.100 as pigment was dispersed in 900 weight parts of water. The resulting dispersion was blended with a solution of 40 weight parts of polyvinyl alcohol (PVA117: Kuraray Co., Ltd.) as aqueous binder in 530 weight parts of water and 3 weight parts of sodium bicarbonate so as to obtain a coating color.

The coating weight on the ink jet recording paper obtained was 2.4 g/m$^2$ as solids on each side of the paper.

The measurement of pH of the paper surface and evaluation of color rendering properties of this paper are as shown in Table 1.

The coating weight of this ink jet recording paper was 2.3 g/m$^2$ as solids on each side of the paper.

Comparative Example 2

An ink jet recording paper was manufactured in exactly the same way as described in Comparative Example 1 excepting that talc was used instead of calcium carbonate, a rosin sizing agent was used instead of alkylketene dimer, and 2.0 weight parts of aluminum sulfate were also blended into the paper.

The results of tests performed on this paper are as shown in Table 1.

TABLE 1

| | Filler in paper | Surface pH | Coating weight per side of paper (g/m$^2$) | Color rendering properties Black | Color rendering properties Cyan | Image quality (blurring) | Waterproof properties | Texture (ordinary paper texture) |
|---|---|---|---|---|---|---|---|---|
| EXAMPLE 1 | Kaolin | 6.0 | 2.4 | ○ | ○ | Good | ○ | Good |
| EXAMPLE 2 | Illite | 7.2 | 2.2 | ○ | ○ | Good | ○ | Good |
| EXAMPLE 3 | Illite | 6.6 | 1.0 | ○ | ○ | Good | ○ | Good |
| EXAMPLE 4 | Kaolin | 7.7 | 2.5 | ○ | ○ | Good | Δ | Good |
| COMPARATIVE EXAMPLE 1 | Calcium carbonate | 7.8 | 2.3 | x | ○ | Good | x | Good |
| COMPARATIVE EXAMPLE 2 | Talc | 5.0 | 2.0 | ○ | x | Good | ○ | Good |
| COMPARATIVE EXAMPLE 3 | Kaolin | 5.7 | — | ○ | ○ | Poor | Δ | Good |
| COMPARATIVE EXAMPLE 4 | Kaolin | 6.1 | 3.9 | ○ | ○ | Good | ○ | Poor |

Example 2

An ink jet recording paper was manufactured in exactly the same way as described in Example 1 excepting that illite was used instead of kaolin, 15 weight parts of a 10 weight % aqueous solution of sodium hydroxide was further added to the coating color, and the coating weight was changed to 2.2 g/m$^2$ as solids on each side of the paper.

The results of tests performed on this paper are as shown in Table 1.

Example 3

An ink jet recording paper was manufactured in exactly the same way as described in Example 1 excepting that illite was used instead of kaolin, and the coating weight was changed to 1.0 g/m$^2$ as solids on each side of the paper.

The results of tests performed on this paper are as shown in Table 1.

Example 4

An ink jet recording paper was manufactured in exactly the same way as described in Example 1 excepting that sodium carbonate was used instead of sodium bicarbonate, and the coating weight was 2.5 g/m$^2$ as solids on each side of the paper.

The results of tests performed on this paper are as shown in Table 1.

Comparative Example 1

85 weight parts of LBKP (c.s.f. 350 ml), 15 weight parts of calcium carbonate as paper filler and 0.15 weight parts of alkylketene dimer as internal sizing agent were blended together, and an ink jet recording paper of weighting 81.4 g/m$^2$ was manufactured using a Fourdrinier paper machine.

Exactly the same coating color as in Example 1, excepting that it did not contain 3 weight parts of sodium bicarbonate, was then applied by a gate roller to both sides of the paper so as to manufacture an ink jet recording paper. The results of tests performed on this paper are as shown in Table 1.

Comparative Example 3

An ink jet recording paper was manufactured in exactly the same way as described in Comparative Example 1 excepting that a coating was not applied when the paper was manufactured.

The results of tests performed on this paper are as shown in Table 1.

Comparative Example 4

An ink jet recording paper was manufactured in exactly the same way as described in Comparative Example 1 excepting that the coating weight was 3.9 g/m$^2$ on each side of the paper.

The results of tests performed on this paper are as shown in Table 1.

What is claimed is:

1. An ink jet recording paper for recording with an ink having a water-soluble dye with hydrophilic functional groups comprising carboxyl groups, said recording paper not containing calcium carbonate, and being formed from a base paper comprising kaolin and/or illite as filler and a recording layer coated on at least one side of said base paper comprising a water-absorbing pigment and an aqueous binder, the amount of solids in said layer lying in the range 0.5–3.0 g/m$^2$ on each side of said paper on which said layer is coated.

2. An ink jet recording paper as defined in claim 1, wherein the amount of kaolin and/or illite used is in the range of 3–30 wt % of the base paper.

3. An ink jet recording paper as defined in claim 1, wherein the proportion of the binder lies within a range of 10–100 weight parts to 100 parts of pigment.

* * * * *